US010233585B2

(12) United States Patent
Fu et al.

(10) Patent No.: US 10,233,585 B2
(45) Date of Patent: Mar. 19, 2019

(54) WASHING MACHINE WITH MODULAR COMPUTER BOARD

(71) Applicants: HAIER GROUP CORPORATION, Shandong (CN); QINGDAO HAIER WASHING MACHINE CO., LTD., Shandong (CN)

(72) Inventors: Xiaodong Fu, Shandong (CN); Qing Liang, Shandong (CN); Tao Liu, Shandong (CN); Yunfeng He, Shandong (CN)

(73) Assignee: Haier Group Corporation, Qindao, Shandong (CN)

( * ) Notice: Subject to any disclaimer, the term of this patent is extended or adjusted under 35 U.S.C. 154(b) by 207 days.

(21) Appl. No.: 15/113,391

(22) PCT Filed: May 29, 2014

(86) PCT No.: PCT/CN2014/078730
§ 371 (c)(1),
(2) Date: Jul. 21, 2016

(87) PCT Pub. No.: WO2015/109714
PCT Pub. Date: Jul. 30, 2015

(65) Prior Publication Data

US 2017/0009391 A1 Jan. 12, 2017

(30) Foreign Application Priority Data

Jan. 22, 2014 (CN) ..... 2014 1 0029727

(51) Int. Cl.
*D06F 39/00* (2006.01)
*D06F 33/02* (2006.01)
(Continued)

(52) U.S. Cl.
CPC ..... *D06F 39/005* (2013.01); *D06F 25/00* (2013.01); *D06F 33/02* (2013.01); *D06F 37/304* (2013.01);
(Continued)

(58) Field of Classification Search
None
See application file for complete search history.

(56) References Cited

U.S. PATENT DOCUMENTS

2003/0028270 A1 2/2003 Peterson et al.
2005/0235306 A1* 10/2005 Fima ..... E03B 1/00 725/10

(Continued)

FOREIGN PATENT DOCUMENTS

CN 1932128 A 3/2007
CN 101838911 A 9/2010

(Continued)

OTHER PUBLICATIONS

International Search Report dated Nov. 4, 2014 from International Patent Application No. PCT/CN2014/078730, filed May 29, 2014.

(Continued)

*Primary Examiner* — Jason Y Ko
*Assistant Examiner* — Cristi J Tate-Sims
(74) *Attorney, Agent, or Firm* — David B. Tingey; Bryant J. Keller; Kirton McConkie

(57) ABSTRACT

Disclosed is a washing machine with a modular computer board, comprising a control circuit board and function control modules respectively connected to corresponding loads, characterized in that the control circuit board comprises a main control module; the function control modules include at least a motor control module, a water feeding control module, and a water discharge control module; at least one of the function control modules is arranged inde- (Continued)

pendently from the control circuit board; and the main control module and the independently arranged function control module are connected to a data bus and a power bus, respectively. A modular construction mode of the computer board control circuit board of the washing machine is achieved by connecting a computer board provided with the main control module to various function control modules respectively via a data bus and a power bus; moreover, the circuit configuration in the washing machine is simplified by mounting the function control modules on or close to corresponding loads.

14 Claims, 11 Drawing Sheets

(51) Int. Cl.

| | |
|---|---|
| ***D06F 25/00*** | (2006.01) |
| *D06F 37/30* | (2006.01) |
| *D06F 39/02* | (2006.01) |
| *D06F 39/04* | (2006.01) |
| *D06F 39/14* | (2006.01) |

(52) U.S. Cl.
CPC ..... *D06F 39/02* (2013.01); *D06F 39/045* (2013.01); *D06F 39/14* (2013.01)

(56) References Cited

U.S. PATENT DOCUMENTS

| | | | | |
|---|---|---|---|---|
| 2006/0206238 | A1* | 9/2006 | Walker | D06F 39/02 700/283 |
| 2006/0277690 | A1 | 12/2006 | Pyo et al. | |
| 2007/0142931 | A1 | 6/2007 | Peral | |
| 2009/0095029 | A1* | 4/2009 | Gelinas | D06F 39/02 68/27 |
| 2012/0068659 | A1* | 3/2012 | Seto | D06F 33/02 318/700 |

FOREIGN PATENT DOCUMENTS

| | | | | |
|---|---|---|---|---|
| CN | 201667629 | U | 12/2010 | |
| EP | 2620535 | A1 * | 7/2013 | D06F 39/005 |
| EP | 2620535 | A1 | 7/2013 | |
| JP | H0924179 | A | 1/1997 | |
| JP | 2008152501 | A | 7/2008 | |

OTHER PUBLICATIONS

Search Report dated Aug. 21, 2017 from European Patent Application No. 2014880085.7 filed May 29, 2014.

* cited by examiner

WASHING MACHINE WITH MODULAR COMPUTER BOARD

FIELD OF THE DISCLOSURE

The present disclosure relates to the field of a washing machine, and in particular to a washing machine with a modular computer board.

BACKGROUND OF THE DISCLOSURE

Nowadays, washing machines are manufactured such that control modules of various loads are generally integrated into one circuit board to control the different external devices of the washing machines respectively, thereby implementing the functions of various loads of the washing machines. With reference to the washing machines manufactured by using above solutions which have different models, it is necessary to manufacture a circuit board that matches with the model of the corresponding washing machines. As a consequence, the circuit board needs to be redesigned, redebugged and reopened mould manufacture during the research and development of new products, which increases cost for research and development and is unfavorable for uniform matching of various models of the washing machines and for improving a modular management during manufacture.

An automatic control system for a washing machine is disclosed in Chinese patent application No. CN201310281507.4, including a main control module, a running system for the washing machines, a clothes amount monitoring module, a water amount control module, a laundry powder amount control module and an integration monitoring unit. The clothes amount monitoring module, the water amount control module and the laundry powder amount control module are connected to the main control module by the integration monitoring unit, respectively, and the main control module is connected to the running system of the washing machine. As compared to the prior art, the automatic control system of the washing machine can automatically control a required amount of water, a required amount of laundry powder and a running time of the washing machine according to the amount of clothes by means of cooperation of the clothes amount monitoring module, the water amount control module, the laundry powder amount control module and the integration monitoring unit and through a comprehensive control of the main control module, thereby improving the automatic level of the washing machine and reducing a energy consumption of the washing machine.

According to above solutions, however, the manufactured computer circuit board is an integral computer board structure that integrates various control lines together. Thus, the whole computer board needs to be replaced after a certain module or control line in the computer board is damaged, which improves the cost of maintenance. Moreover, upgrades of products or new demands from the customers needs to redesign the computer board, which leads to a long developing period and a higher cost for research and development. At the same time, the computer board modules integrated as a whole are controlled to be connected to or disconnected from the corresponding loads through a power bus. Since a distance between the computer board modules and the actual loads is relatively far, the various control lines in the washing machines are caused to be long and complex in routing, which is unfavorable for fault analysis of the products and makes the judgment of faults more difficult.

In view of above, the present disclosure is made.

SUMMARY OF THE DISCLOSURE

An object of the present disclosure is to provide a washing machine with modular computer board that is capable of producing and mounting the computer board of the washing machine in a modular way. To achieve the object of the disclosure, the following solutions are adopted.

A washing machine with a modular computer board, comprises a control circuit board and function control modules, and each of the control modules is connected to corresponding loads, respectively, where the control circuit board comprises a main control module, the function control module comprises at least a motor control module, a water feeding control module, and a water discharge control module, at least one of the function control modules is arranged independently from the control circuit board, and the main control module and the function control modules arranged independently are connected to a data bus and a power bus, respectively.

Further, at least two of the function control modules are arranged independently from the control circuit board, respectively.

Further preferably, all the function control modules are arranged independently from the control circuit board, respectively.

Further, each of the function control modules arranged independently is disposed at any position between a cylinder and a housing of the washing machine. The housing of the washing machine may include any one of outermost structural members of any one of the washing machine, such as a casing, a base, a control panel or the like. That is, each of the respective function control modules arranged independently may be mounted at any position of the washing machine.

Further, each of the function control modules arranged independently is mounted on or close to the corresponding loads.

Further, the function control modules arranged independently and the main control module are connected in series via the data bus. each of the function control modules arranged independently and the main control module are connected in series via the power bus.

Further, the control circuit board having the main control module provided therein is mounted at a control panel, the main control module is connected to the control panel and is connected to each of the function control modules in series, so as to process and analyze a human-machine communication information reflected by the control panel and information of a feedback from each of the function control modules and send command signals to each of the e function control modules.

Further, a load of the motor control module is a load motor, such as a series-excited motor, a variable-frequency motor or a DD motor (direct driver motor); and the motor control module is disposed in an independent circuit board which is mounted on or close to the load motor; a load of the water feeding control module is a water feeding valve for controlling the opening and closing of a water feeding tube, the water feeding control module is disposed in the independent circuit board which is mounted close to the water feeding valve, and a load of the water discharge control module is a water discharge assembly that is a water discharge pump and/or a water discharge valve for controlling on and off of a water discharge tube, the water discharge control module is disposed in the independent circuit board which is mounted close to the water discharge assembly.

Further, each of separate circuit boards that are provided with the motor control module, the water feeding control model and the water discharge control module respectively has a data bus terminal and a power bus terminal. In particular, the data bus terminals and the power bus terminals of each of the function control modules are connected to the data bus and to the power bus, respectively.

Further, the data bus extends initially from the main control module and connects in series each of the function control modules that are disposed at or close to the loads in turn, thereby achieving a information transmission between the function control modules that are disposed on or close to the loads. The power bus extends initially from the main control module and connects in series each of the function control modules that are disposed on or close to the loads in turn, therebying achieving a power distribution of the various function control modules that are disposed at or close to the loads.

Further, the function control modules further include one of a door lock control module, a drying control module, an automatic delivery control module and a heating control module, or combinations of at least two of them.

At least one of the door lock control module, the drying control module, the automatic delivery control module and the heating control module are disposed indendently from the control circuit board.

The door lock control module, the drying control module, the automatic delivery control module and the heating control module are disposed indendently from the control circuit board, respectively.

Further, the function control modules may include the door lock control module, a load of which is a door lock for locking the door body of the washing machine; and preferably, the door lock control module is an intelligent control computer board that is mounted at the door lock of the washing machine for controlling the opening and closing state of the door lock of the washing machine.

Further, the function control modules may include the drying control module, a load of which is various drying assemblies constituting of a clothes drying systems of the washing machine; and preferably, the drying control module is an intelligent computer board that is mounted close to the drying assemblies for controlling the operation states of the drying assemblies of the washing machine.

Further, the function control modules may include an automatic delivery control module, a load of which is an automatic delivery module for controlling the delivery of a detergent from a detergent cartridge; and preferably, the automatic delivery control module is an intelligent control computer board that is mounted close to the automatic delivery module for controlling the amount of delivery of the liquid detergent and/or detergent powder and/or softener in the washing machine.

Further, the function control modules may include the heating control module, a load of which is a heating assembly of the heating system; preferably, the heating assembly is heating wires, heating tubes or thermal pump system; and further preferably, the heating control module is an intelligent control computer board that is mounted close to the heating assembly for controlling the heating state of the heating assembly of the washing machine.

Further, each of the function control modules is provided with a data bus terminal that is connected to the data bus and a power bus terminal that is connected to the power bus, respectively. Each of the control modules is connected directly to the corresponding loads such that the control modules that are disposed at or close to the loads can directly send the control commands to the loads.

Further, the various function control modules and the main control module that are disposed in the control circuit board are connected to each other via connection circuits disposed in the control circuit board.

Further, the various function control modules and the main control module that are disposed in the control circuit board are connected to the power bus via the power bus terminal respectively, and the various function control modules and the main control module that are disposed in the control circuit board are connected to the data bus respectively via the data bus terminal.

Further, the various function control modules that are disposed in the control circuit board or disposed independently are connected to the corresponding loads via connecting lines, respectively.

According to the disclosure, a plurality of data bus terminals and a plurality of power bus terminals that are connected to the respective function control modules are reserved in the data bus and the power bus, such that the respective function control modules are mounted in the circuit board depending on different assembled components of different models of the washing machine. In this way, the modular assembly of the computer board of the washing machine can be achieved, and platform-based connection of the washing machine is realized, which largely shortens the developing cycle of products and reduces the maintenance cost of products after selling. Meanwhile, with the washing machine constituted by modular circuit boards as described above, the personalized requirements of customers can be responded rapidly, the upgrade of products is quick and convenient, thereby greatly reducing the developing cost.

Since adopting the above solution, the present disclosure has advantages over the prior art in that the computer board with a main control module is connected to the various function control modules via the power bus and the data bus, respectively, such that the control circuit board of the computer board in the washing machine achieves a pattern of modular constitution. In the meantime, the various function control modules are mounted at or close to the corresponding loads, such that the lines between the loads and the control modules can be shortened, thereby simplifying the line structure within the washing machine and improving the speed of information transmission between the loads and the control modules. More particularly, because the corresponding control modules for different loads are configured to be independent modules, as long as the corresponding modules are replaced the repairing of washing machine will be able to be completed if the modules are damaged at a later time, which simplifies the maintenance process and reduces the maintenance cost. Also, the present disclosure has a simpler structure and a significant effect and thus is favorable for popularity.

REFERENCE NUMERAL LIST

1—main control module 2—power bus 3—data bus 4—water feeding control module 5—water discharge control module 6—door lock control module 7—drying control module 8—automatic delivery control module 9—heating control module 11—control panel 10—motor control module 12—power adaptor 41—water feeding valve 51—water discharge valve 61—door lock 71—drying assembly 101—load motor 81—automatic delivery module 82—detergent cartridge 91—heating wire

DETAILED DESCRIPTION OF THE EMBODIMENTS

The present disclosure will be described in further detail with reference to embodiments.

Figure 1:
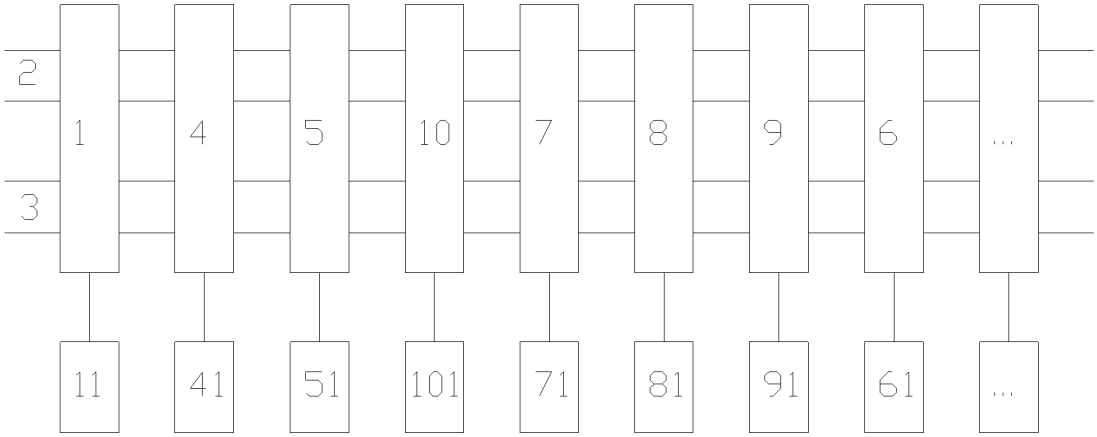
FIG. 1 is a structure schematic view of the present disclosure.

As illustrated in FIG. 1, a washing machine with modular computer board is disclosed by the present disclosure which comprises a control circuit board and a function control module. The control circuit board includes a main control module 1, a power bus terminal connecting the main control module 1 with a power bus 2 and a data bus terminal connecting the main control module 1 with a data bus 3. The function control module may include at least a motor control module 10, a water feeding control module 4 and a water discharge control module 5. In particular, the motor control module 10, the water feeding control module 4 and the water discharge control module 5 are disposed at any one position between a cylinder and a housing of the washing machine, respectively, and each of the function control modules are connected to the data bus 3 and the power bus 2.

In this embodiment, each of the function control modules is respectively connected to the corresponding loads and t mounted on or close to the corresponding loads. A load of the main control module 1 is a control panel 11 at which the circuit board having the main control module 1 is mounted, and the control panel 11 further includes human-machine interactive devices such as keys, a digital tube, an LCD display screen, or the like. The loads of the main control module 1 is the function control modules, so as to after processing and analyzing the human-machine interactive information reflected by the control panel 11 and the information from a feedback of the various function control module, and then to send command signals to each of the function control modules, such that each of the function control modules can control the corresponding loads in accordance with the corresponding command signals.

In the present embodiment, a load of the motor control module 10 is a load motor 101 which may be any one of a series-excited motor, a variable frequency motor or a DD motor, etc. The motor control module 10 may be disposed in a separate circuit board or in the control circuit board. Preferably, the separate circuit board with the motor control module 10 is mounted on or close to the load motor 101. It is further preferable that the motor control module 10 is an intelligent computer board mounted in the load motor 10.

According the present embodiment, a load of the water feeding control module 4 is a water feeding assembly for controlling on and off states of a water feeing tube. In the present embodiment, the water feeding assembly is configured as a water feeding valve 41, and the water feeding control module 4 may be disposed in a separate circuit board or in the control circuit board. Preferably, the separate circuit board with the water feeding control module 4 is mounted close to the water feeding valve 41. It is further preferable that the water feeding control module 4 is an intelligent computer board mounted in proximity to the water feeding valve 41.

In the present embodiment, a load of the water discharge control module 5 is a load water-discharging assembly that is a water discharge pump and/or a water discharge valve 51 for controlling opening and closing of a water discharge tube. According to the present embodiment, the load water-discharging assembly is the water discharge valve 51. The water discharge control module 5 may be disposed in a separate circuit board or in the control circuit board. Preferably, the separate circuit board with the water discharge control module 5 is mounted in proximity to the water discharge valve 51. Further preferably, the water discharge control module 5 is an intelligent computer board mounted close to the water discharge valve 51.

According to the present embodiment, all the separate circuit boards as described above may be circuit boards that are separated and disposed independent from the control circuit board. Therefore, the corresponding function control module of each load may be disposed independently, thus the steps of maintenance and replacement of the circuit boards are simplified, and the maintenance and production efficiency of washing machine can be improved.

In the present embodiment, each of the motor control module 10, the water feeding control module 4 and the water discharge control module 5 is provided with a data bus terminal and a power bus terminal, To be more specific, the data bus terminal and the power bus terminal of each of the respective function control modules are connected to the data bus 3 and the power bus 2, respectively.

Under the condition that the power bus terminal of each of the function control modules is connected to the power bus, the function control modules can control the connection and disconnection between the power bus and the various loads such that the corresponding loads can obtain the power supply to act. In the meantime, under the condition that the data bus terminal of the function control modules is connected to the data bus, the human-machine interactive information received by the main control module is conveyed to the function control modules to control the action states of the corresponding loads, or the action information of the loads are feeded back to the main control module to implement transmission of information between the main control module and each of the function control modules.

Figure 2:
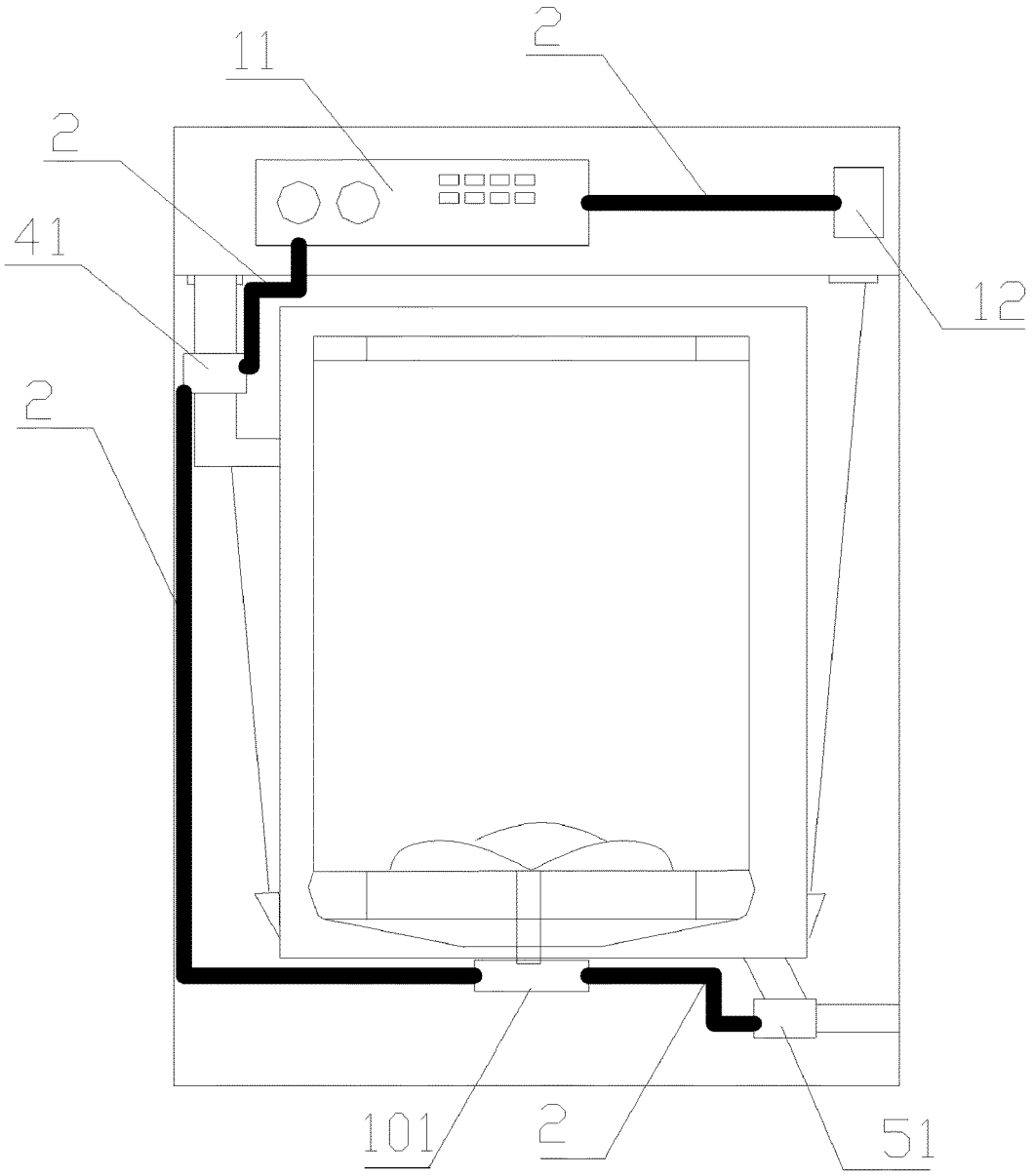
FIG. 2 is a schematic view illustrating connection of a power bus of the present disclosure.

In the present embodiment, the data bus 3 extends toward inside of the housing of the washing machine from the control panel at an upper portion of the washing machine, and sequentially passes through the water feeding valve 41, the load motor 101 and the water discharge valve 51, as shown in FIG. 2. The data bus 3 is provided with corresponding ports at the water feeding valve 41, the load motor 101 and the water discharge valve 51 respectively, and each of the ports is connected to the corresponding terminals of the water feeding control module 4, the motor control module 10 and the water discharge control module 5, respectively. The transmission of information among the function control modules disposed on or close to the loads is achieved, under the condition that the the main control module, the water feeding control module, the motor control module and the water discharge module are connected in series in turn via the data bus. In the present embodiment, the above-mentioned main control module may be connected to each of the function control modules in series in any order via the data bus.

Figure 3:
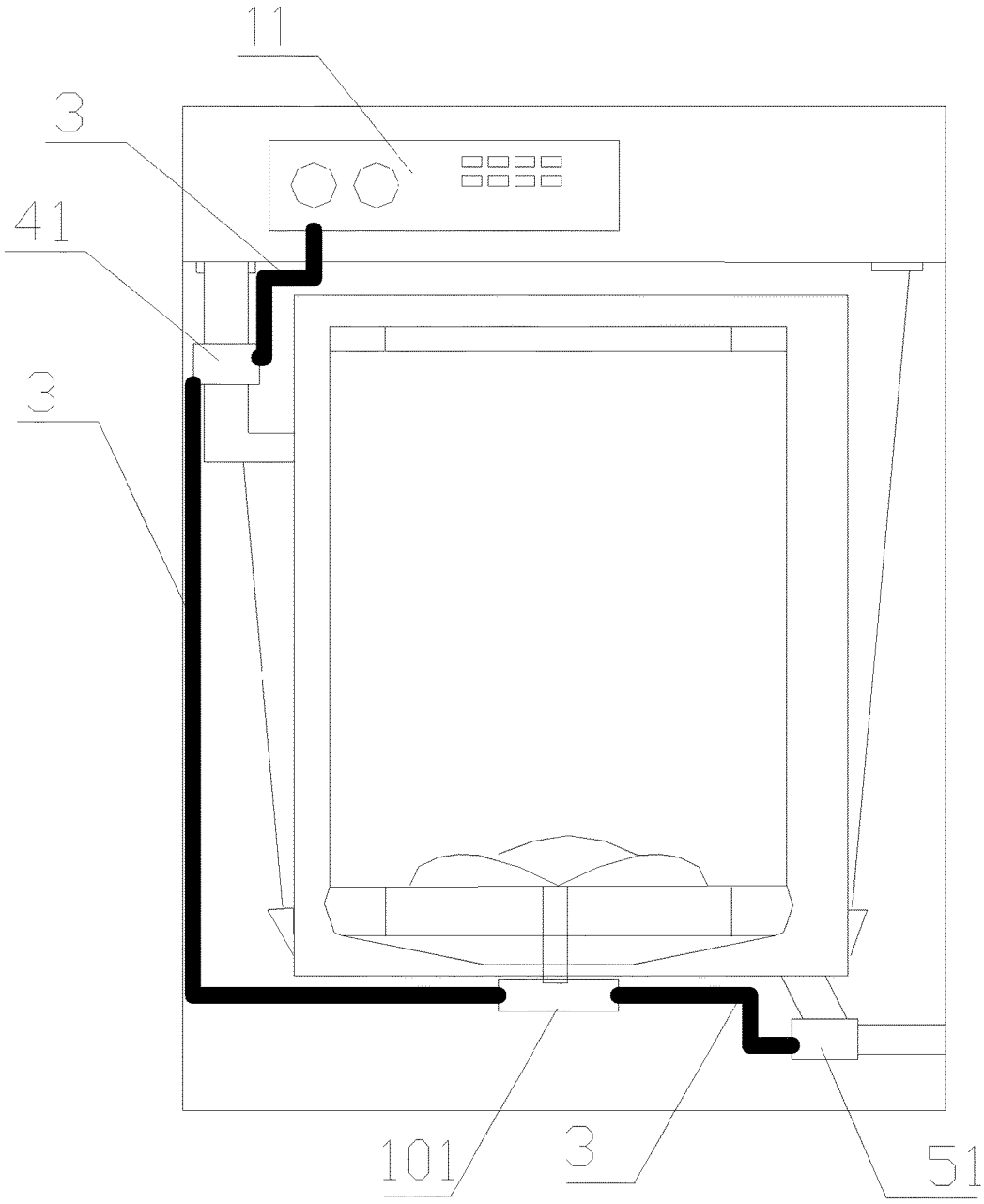
FIG. 3 is a schematic view illustrating connection of a data bus of the present disclosure.

According to the present embodiment, the power bus 2 extends toward inside of the housing of the washing machine from the power adaptor of the washing machine, and sequentially passes through the control panel 11, the water feeding valve 41, the load motor 101 and the water discharge valve 51, as shown in FIG. 3. The power bus 2 is provided with corresponding ports at the control panel 11, the water feeding valve 41, the load motor 101 and the water discharge valve 51 respectively, and each of the ports are connected to the corresponding terminals of the main control module 1, the water feeding control module 4, the motor control module 10 and the water discharge control module 5, respectively. The power distribution among the various function control modules disposed on or close to the loads is achieved, under the condition that the main control module, the water feeding control module, the motor control module and the water discharge control module are connected in series in turn via the power bus. In the present embodiment, the above-mentioned main control module may be connected to each of the function control modules in series in any order via the power bus.

First Embodiment

In the present embodiment, the function control modules may include a door lock control module 6, a load of which is a door lock 61 of the washing machine, and the door lock 61 is mounted on the housing or body of the door of the washing machine as a device for locking/unlocking the body of the door of the washing machine to be in closing/opening state. The door lock control module 6 may be disposed in a separate circuit board or in the control circuit board. Preferably, the door lock control module 6 is an intelligent computer board that is mounted on the door lock 61 of the washing machine for controlling opening and closing states of the door lock 61 of the washing machine. The intelligent control computer board for forming the door lock control module 6 may be directly connected to the door lock 61 of the washing machine.

Figure 4:
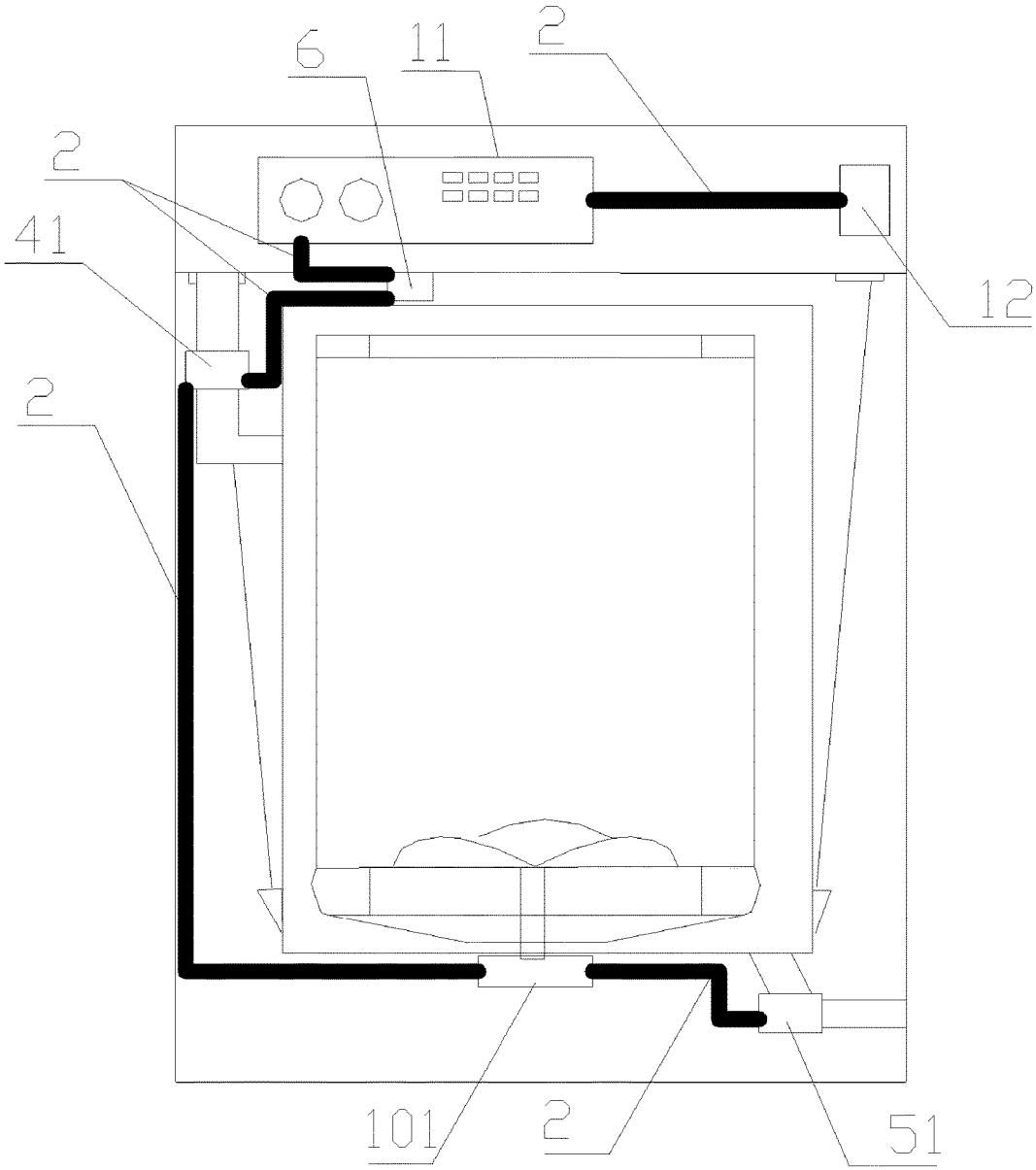
FIG. 4 is a schematic view illustrating connection of the power bus according to a first embodiment of the present disclosure.

As illustrated in FIG. 4, according to the present embodiment, the data bus 3 sequentially passes through the control panel 11, the door lock 61, the water feeding valve 41, the load motor 101 and the water discharge valve 51. The data bus 3 has the corresponding ports provided at the respective loads, and each of the ports is respectively connected to the terminals of the door lock control module 6, the water feeding control module 4, the motor control module 10 and the water discharge control module 5 such that the main control module, the door lock control module, the water feeding control module, the motor control module and the water discharge control module are sequentially connected in series via the data bus, thereby implementing the transmission of information among the function control modules that are disposed on or close to the respective loads. In the present embodiment, the main control module may be connected in series to each of the function control modules in any order via the data bus.

Figure 5:
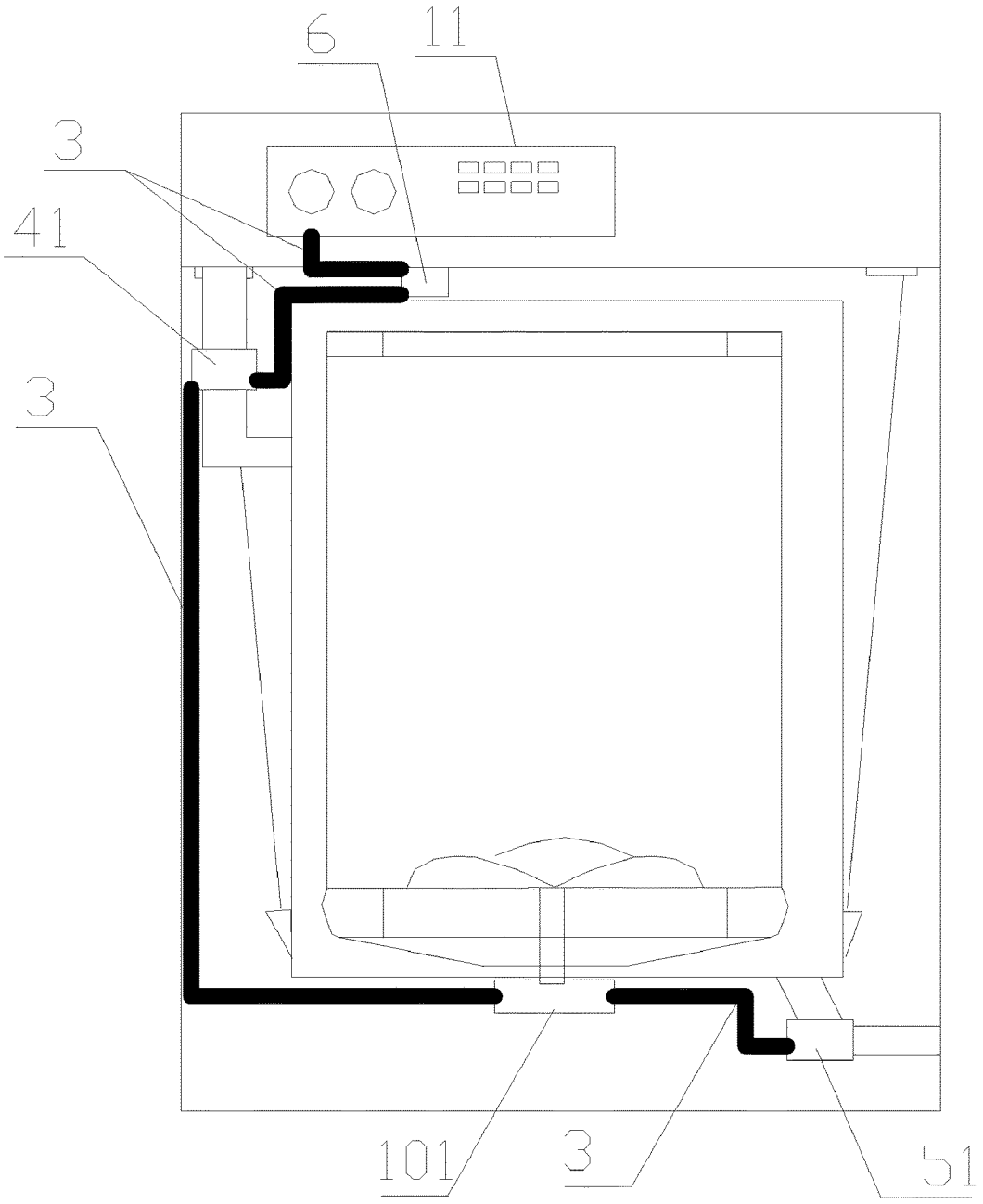
FIG. 5 is a schematic view illustrating connection of the data bus according to the first embodiment of the present disclosure.

In the present embodiment, the power bus 2 extends toward inside of the housing of the washing machine from the power adaptor of the washing machine, and sequentially passes through the control panel 11, the door lock 61 of the washing machine, the water feeding valve 41, the load motor 101 and the water discharge valve 51, as shown in FIG. 5. The power bus 2 is provided with corresponding ports at each of the loads respectively, and each of the ports is connected to the terminals of the main control module 1, the door lock control module 6, the water feeding control module 4, the motor control module 10 and the water discharge control module 5, respectively. The power distribution among the function control modules disposed on or close to the loads are achieved, under the condition that the main control module, the door lock control module, the water feeding control module, the motor control module and the water discharge module are connected in series in turn via the power bus. In the present embodiment, the above-mentioned main control module may be connected in series to the function control modules in any order via the power bus.

Second Embodiment

In this embodiment, the function control modules may include a drying control module 7, the load of which is various drying assemblies 71 for forming a clothes drying system of the washing machine, as shown in FIG. 1. In particular, the drying control module 7 may be disposed in a separate circuit board or in the control circuit board. Preferably, the drying control module 7 is an intelligent control computer board that is mounted in proximity to the drying assemblies for controlling the operation states of the drying assemblies 71 of the washing machine. The intelligent control computer board for constituting of the drying control module 7 can be directly connected to the drying assemblies.

Figure 6:
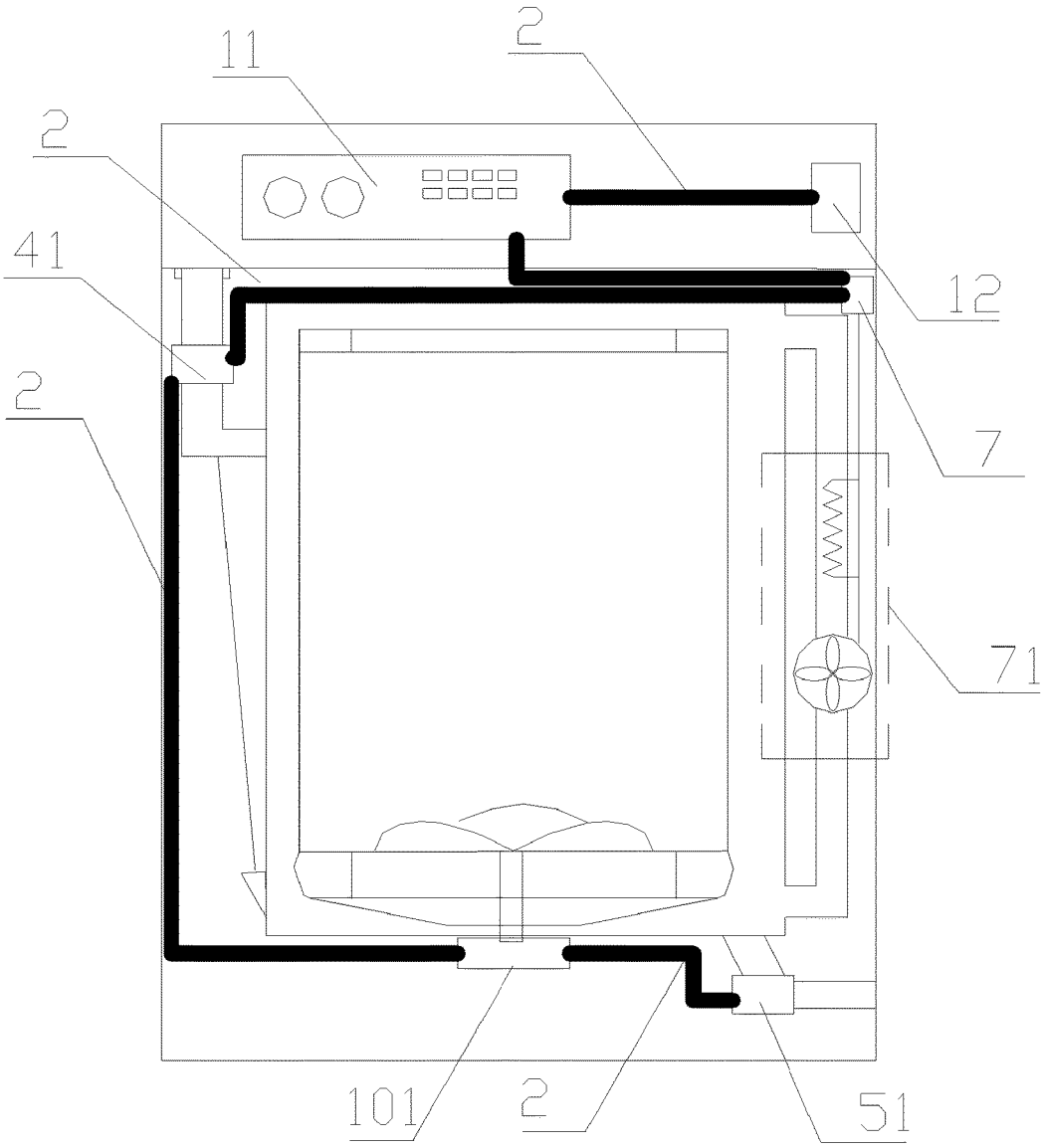
FIG. 6 is a schematic view illustrating connection of the power bus according to a second embodiment of the present disclosure.

As illustrated in FIG. 6, according to the present embodiment, the data bus 3 sequentially passes through the control panel 11, the drying assemblies 71, the water feeding valve 41, the load motor 101 and the water discharge valve 51. The data bus 3 is provided with the corresponding ports at each of the loads, and each of the ports is respectively connected to the terminals of the drying control module 7, the water feeding control module 4, the motor control module 10 and the water discharge control module 5, such that the main control module, the drying control module, the water feeding control module, the motor control module and the water discharge control module are sequentially connected in series via the data bus, thereby implementing the transmission of information among the function control modules that are disposed on or close to the respective loads. In the present embodiment, the above-mentioned main control module may be connected in series to the function control modules in any order via the data bus.

Figure 7:
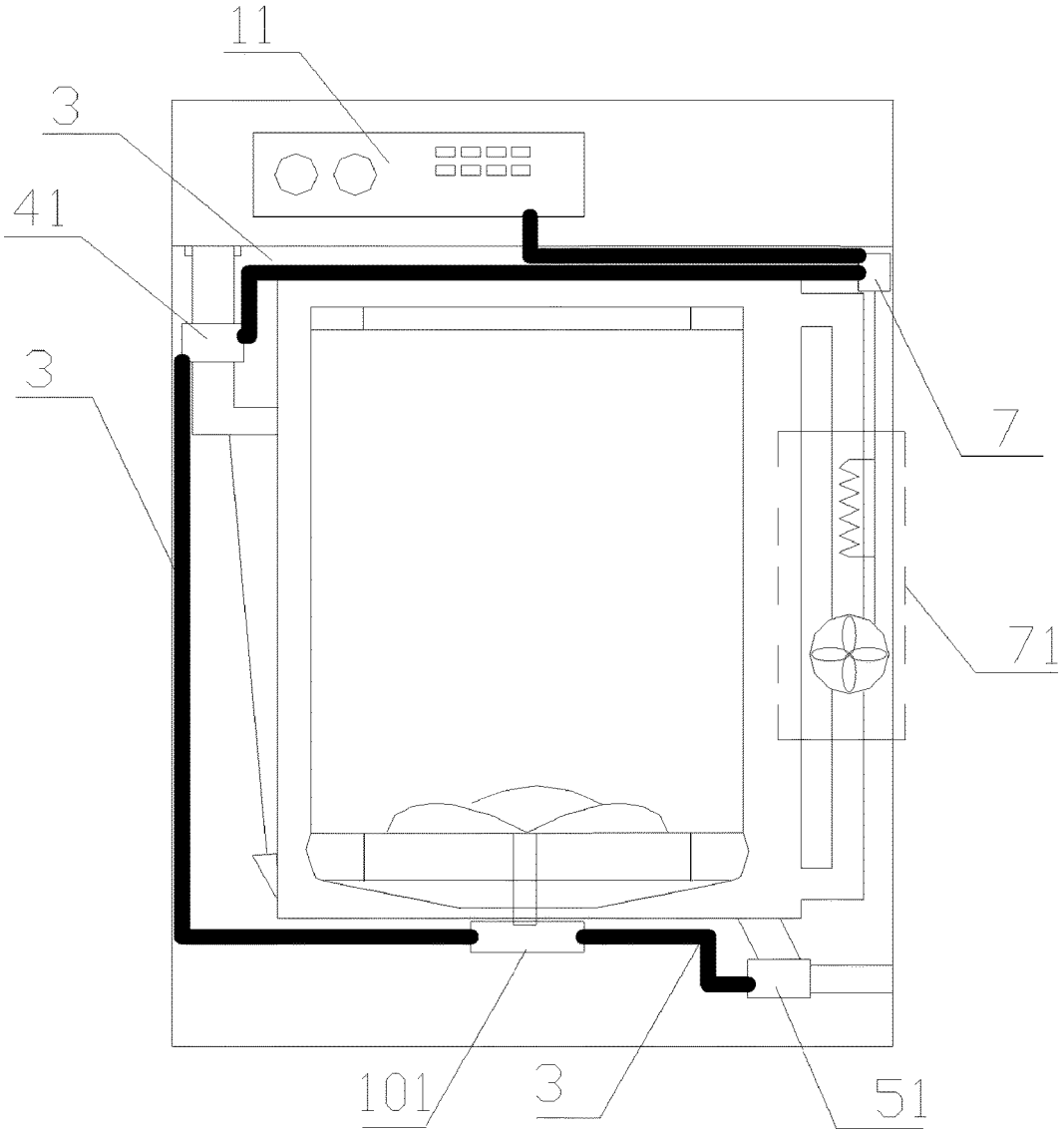
FIG. 7 is a schematic view illustrating connection of the data bus according to a second embodiment of the present disclosure.

In the present embodiment, the power bus 2 extends toward inside of the housing of the washing machine from the power adaptor 12 of the washing machine, and sequentially passes through the control panel 11, the drying assemblies 71, the water feeding valve 41, the load motor 101 and the water discharge valve 51, as shown in FIG. 7. The power bus 2 is provided with corresponding ports at each of the loads respectively, and each of the ports is connected to the terminals of the main control module 1, the drying control module 7, the water feeding control module 4, the motor control module 10 and the water discharge control module 5, respectively. The power distribution among the function control modules disposed at or close to the loads are achieved, under the condition that the main control module, the drying control module, the water feeding control module, the motor control module and the water discharge module are connected in series in turn via the power bus. In the present embodiment, the above-mentioned main control module may be connected in series to the function control modules in any order via the power bus.

Third Embodiment

In the present embodiment, the function control modules may include an automatic delivery control module 8 as illustrated in FIG. 1, which may be disposed in a separate circuit board or in the control circuit board. A load of the automatic delivery control module 8 may be an automatic delivery module 81 for controlling the delivery of a detergent from a detergent cartridge 81. According to the present embodiment, the automatic delivery module 81 is formed by an automatic delivery apparatus that is communicated with an outer cylinder of the washing machine via a delivery pipeline, and a control valve is provided in the delivery pipeline. Preferably, the automatic delivery control module 8 is an intelligent control computer board that is mounted in proximity to the control valve for controlling the amount of delivery of liquid detergent and/or detergent powder and/or softener of the washing machine. The intelligent control computer board for forming the automatic delivery control module 8 can directly connected to the control valve forming the automatic delivery module 81.

Figure 8:
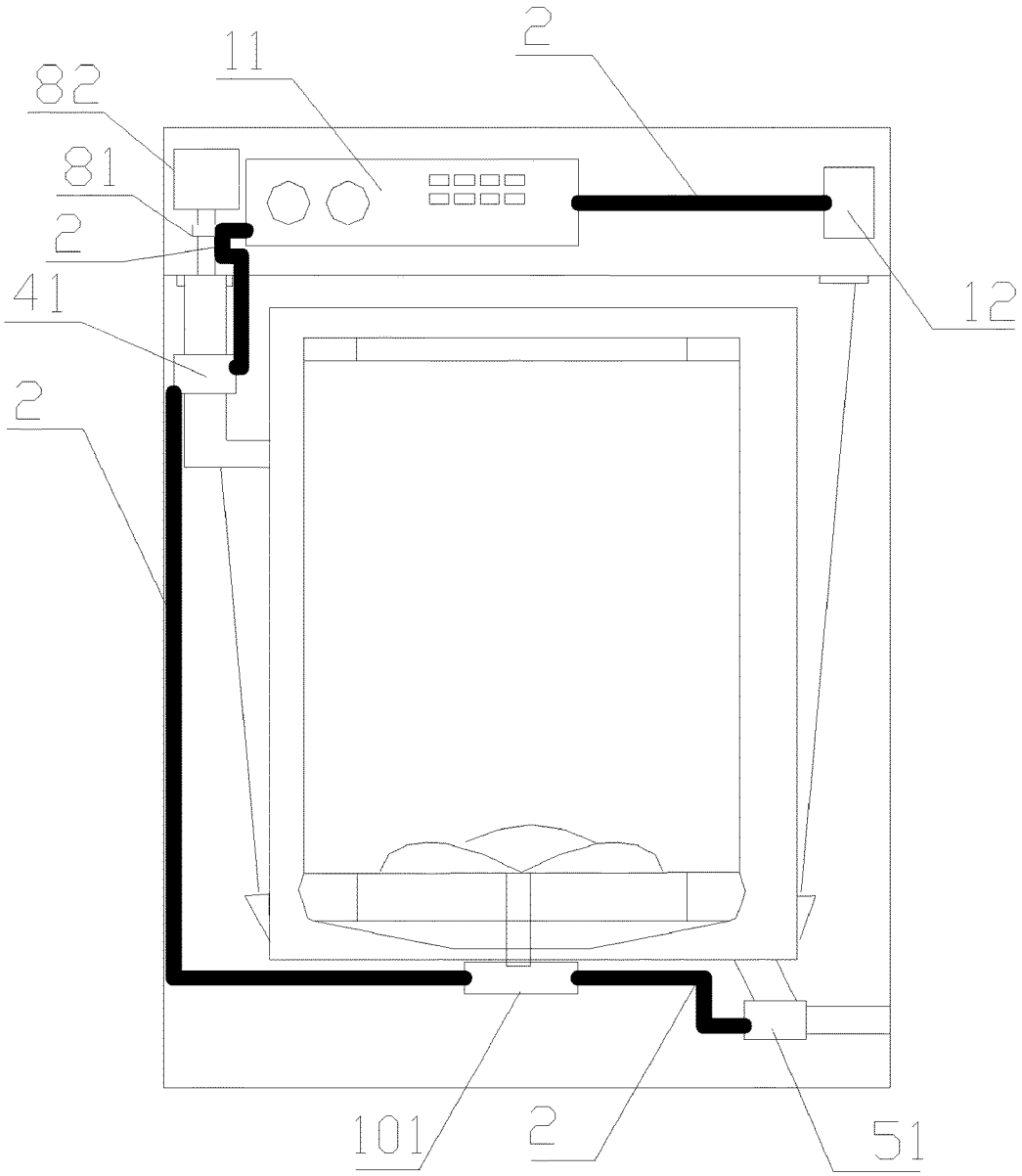
FIG. 8 is a a schematic view illustrating connection of the power bus according to a third embodiment of the present disclosure.

As illustrated in FIG. 8, according to the present embodiment, the data bus 3 sequentially passes through the control panel 11, the automatic delivery module 81 of the detergent cartridge, the water feeding valve 41, the load motor 101 and the water discharge valve 51. The data bus 3 is provided with corresponding ports at the respective loads, and each of the ports is respectively connected to the terminals of the automatic delivery control module 8, the water feeding control module 4, the motor control module 10 and the water discharge control module 5, such that the main control module, the automatic delivery control module, the water feeding control module, the motor control module and the water discharge control module are sequentially connected in series via the data bus, thereby implementing the transmission of information among the function control modules disposed on or close to the respective loads. In the present embodiment, the above-mentioned main control module may be connected in series to the function control modules in any order via the data bus.

Figure 9:
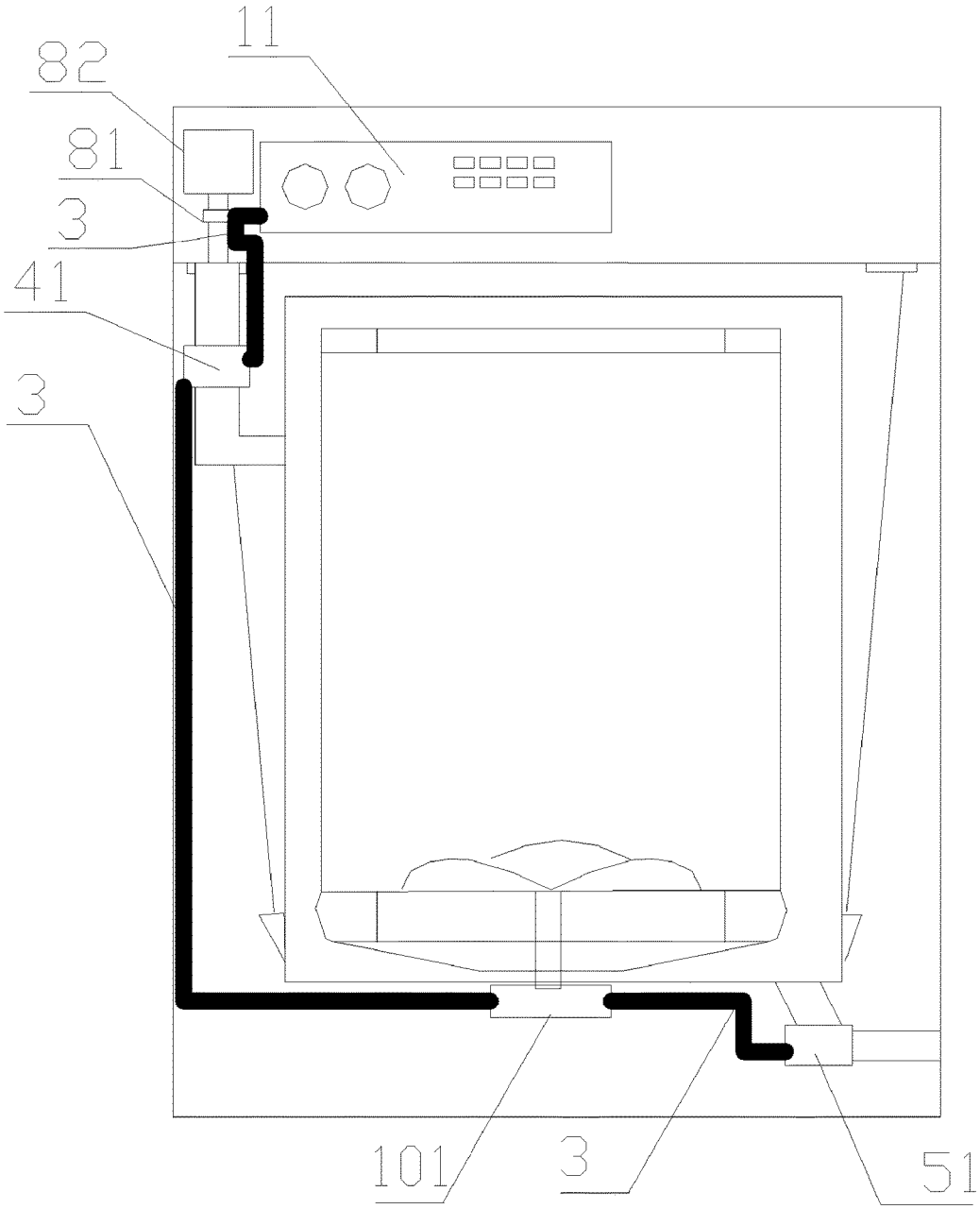
FIG. 9 is a a schematic view illustrating connection of the data bus according to a third embodiment of the present disclosure.

In the present embodiment, the power bus 2 extends toward inside of the housing of the washing machine from the power adaptor of the washing machine, and sequentially passes through the control panel 11, the automatic delivery module 81 of the detergent cartridge 82, the water feeding valve 41, the load motor 101 and the water discharge valve 51, as shown in FIG. 9. The power bus 2 is provided with corresponding ports at each of the loads respectively, and each of the ports is connected to the terminals of the main control module 1, the automatic delivery control module, the water feeding control module 4, the motor control module 10 and the water discharge control module 5, respectively. The power distribution among the function control modules disposed at or close to the loads are achieved under the condition that the main control module, the automatic delivery control module, the water feeding control module, the motor control module and the water discharge module are connected in series in turn via the power bus. In the present embodiment, the above-mentioned main control module may be connected in series to the function control modules in any order via the power bus.

Fourth Embodiment

In the present embodiment, the function control modules may include a heating control module 9, as shown in FIG. 1, which may be disposed in a separate circuit board or in the control circuit board. A load of the heating control module is a heating assembly in the heating system. The heating assembly may include any one of a heating wire 91, a heating tube or a thermal pump system, or the like. Preferably, the heating assembly in the present embodiment is the heating wire 91. It is preferable that the heating wire 91 is provided in a water feeding pipeline for heating the incoming water flow. The heating control module 9 may be an intelligent control computer board that is mounted in proximity to the heating wire 91 for controlling the heating states of the heating assembly of the washing machine. The intelligent control circuit forming the heating control module 9 can directly connected to the heating wire 91.

Figure 10:
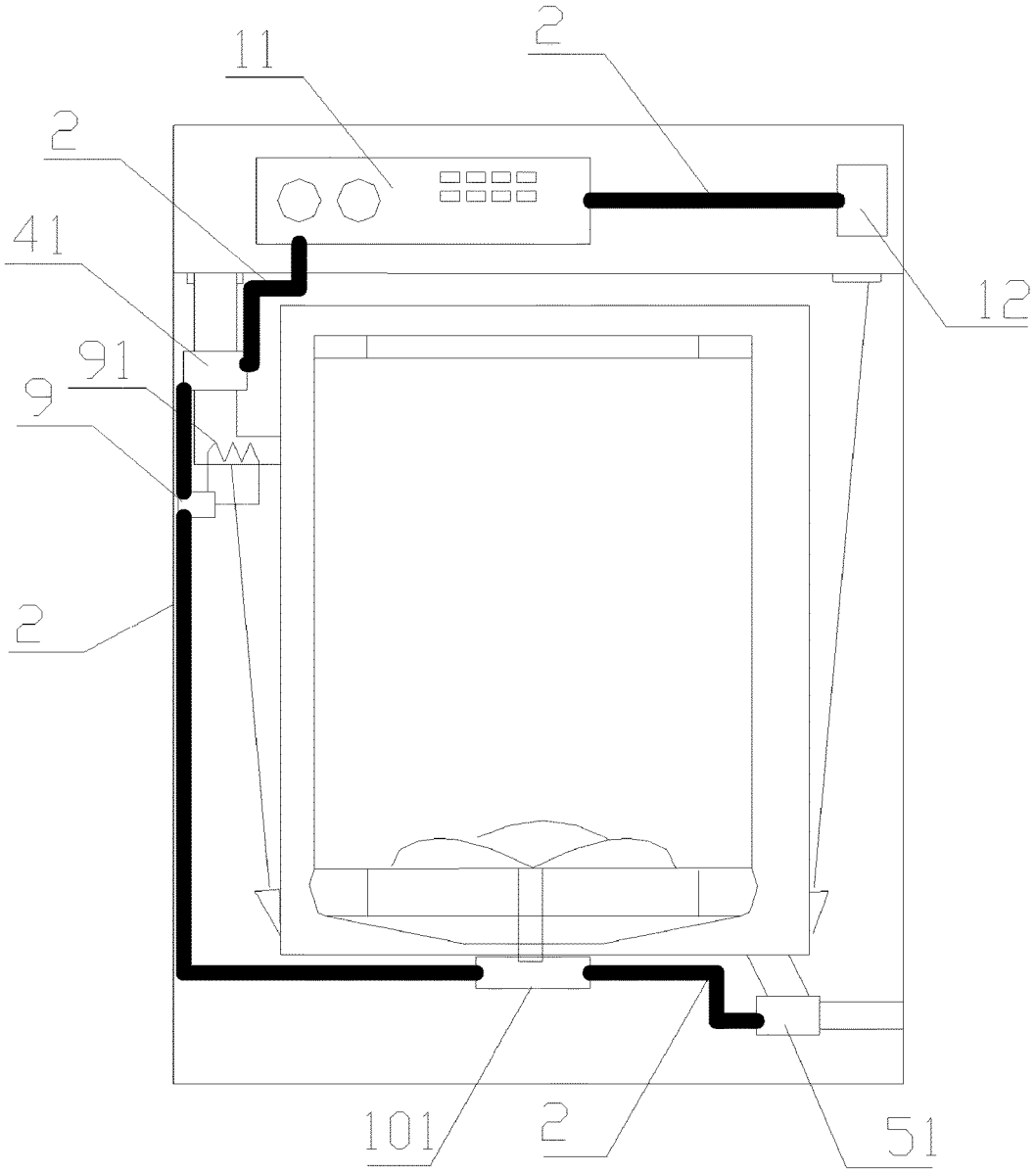
FIG. 10 is a a schematic view illustrating connection of the power bus according to a fourth embodiment of the present disclosure.

As illustrated in FIG. 10, according to the present embodiment, the data bus 3 sequentially passes through the control panel 11, the water feeding valve 41, in proximity to the heating wire 91, the load motor 101 and the water discharge valve 51. The data bus 3 is provided with corresponding ports at the respective loads, and each of the ports is respectively connected to the terminals of the water feeding control module 4, the heating control module 9, the motor control module 10 and the water discharge control module 5, such that the main control module, the water feeding control module, the heating control module, the motor control module and the water discharge control module are sequentially connected in series via the data bus, thereby implementing the transmission of information among the function control modules disposed at or close to the respective loads. In the present embodiment, the above-mentioned main control module may be connected in series to the various function control modules in any order via the data bus.

Figure 11:
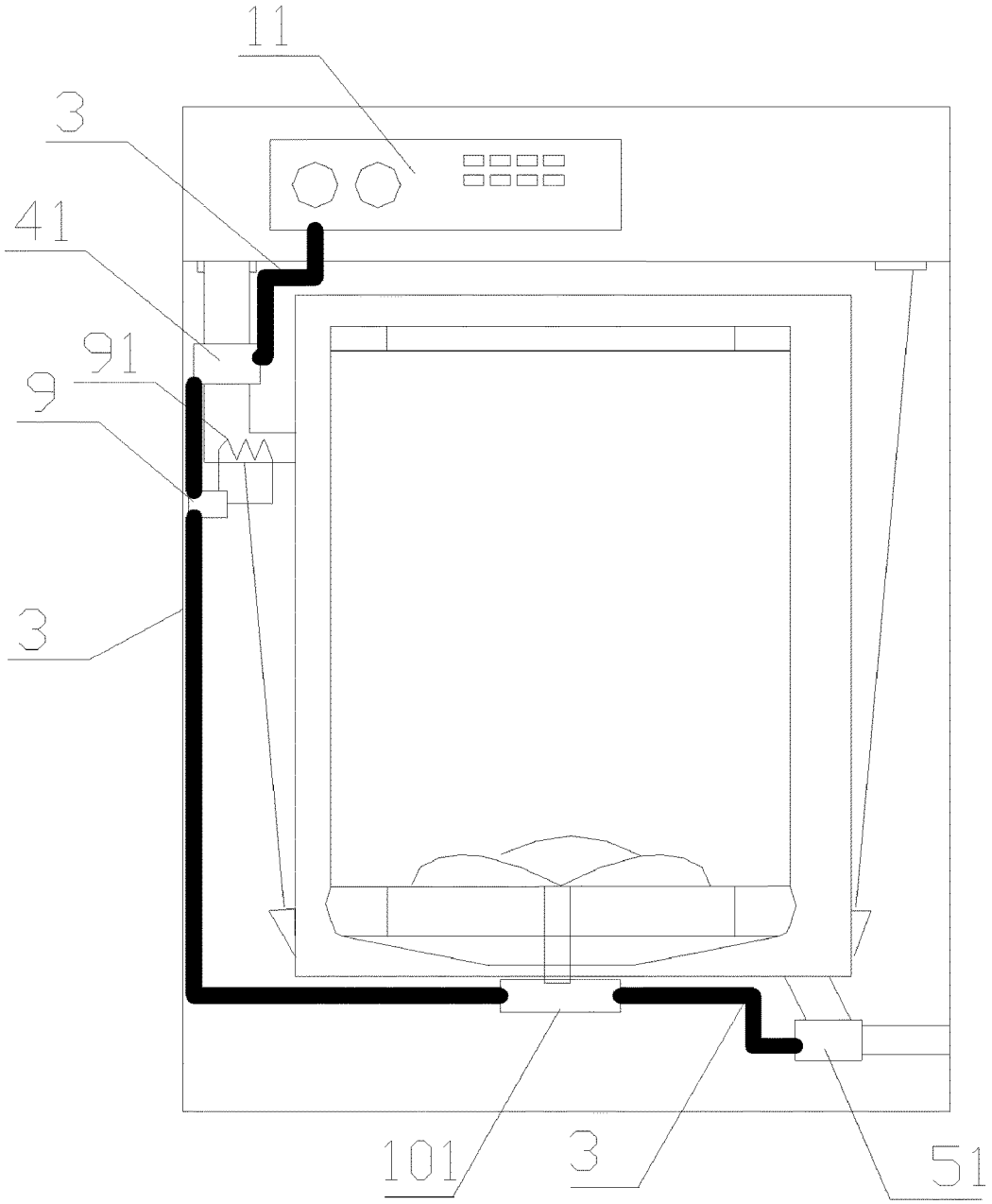
FIG. 11 is a a schematic view illustrating connection of the data bus according to a fourth embodiment of the present disclosure.

In the present embodiment, the power bus 2 extends toward inside of the housing of the washing machine from the power adaptor of the washing machine, and sequentially passes through the control panel 11, the water feeding valve 41, in proximity to the heating wire 91, the load motor 101 and the water discharge valve 51, as shown in FIG. 11. The power bus 2 is provided with corresponding ports at each of the loads respectively, and each of the ports is connected to the terminals of the main control module 1, the water feeding control module 4, the heating control module 9, the motor control module 10 and the water discharge control module 5, respectively. The power distribution among the function control modules disposed at or close to the loads are achieved under the condition that the main control module, the water feeding control module, the heating control modules, the motor control module and the water discharge module are connected in series in turn via the power bus. In the present embodiment, the above-mentioned main control module may also be connected in series to the function control modules in any order via the power bus.

Fifth Embodiment

The present embodiment is different from the disclosure of the first embodiment to the fourth embodiment in that at least one of the function control modules and the main control module are disposed in the control circuit board. Particularly, each of the function control modules that is commonly disposed in the control circuit board with the main control module is connected to the corresponding loads via connecting lines, respectively. At the same time, the control circuit board provided with the main control module and at least one function control modules can connect in series in turn each of the others function control modules in a circuit board that is relatively independent from the control circuit board via the power bus and the data bus. The independent circuit board with the respective function control modules may be mounted on or close to the corresponding loads.

The main control module and each of the function control modules that are commonly disposed in the control circuit board can be connected to each other through connection circuits, and the main control module and each of the function control modules are connected to the power bus via the power bus terminal and to the data bus via the data bus terminal, such that the main control module and each of the function control modules that are provided in the control circuit board can be connected in series to the other function control modules in the independent circuit board, thereby achieving the effects of connecting the main control module and each of the function control modules with each other and thus realizing the object of data transmission among the various modules and power control.

Each of the function control modules that are disposed in the control circuit board or the independent circuit board as described above can be connected to the respective loads through connection lines, thereby achieving the control of each load components of the washing machine.

The examples in above embodiments can further combined or replaced, and the examples are merely descriptions of the preferable embodiments of the present disclosure, instead of defining the idea and scope of the disclosure. Various changes and improvements to the solution of the disclosure made by a person skilled in the art still fall within the scope of the present disclosure without departing from the design concept of the present disclosure.

What is claimed is:

1. A modular computer board for a washing machine, comprising a control circuit board and function control modules, and each of the function control modules is connected to corresponding loads, respectively, wherein the control circuit board comprises a main control module, the function control modules comprise a motor control module, a water feeding control module, and a water discharge control module, at least one of the function control modules is arranged independently from the control circuit board, and the main control module and function control modules arranged independently are connected to a data bus and a power bus, respectively;

wherein a load of the main control module comprises a control panel of the washing machine, a load of the water feeding control module comprises a water feeding valve of the washing machine, a load of the motor control module comprises a load motor of the washing machine, and a load of the water discharge control module comprise a water discharge valve of the washing machine;

the data bus sequentially passes through the control panel, the water feeding valve, the load motor and the water discharge valve, the data bus is provided with corresponding ports at the control panel, the water feeding valve, the load motor and the water discharge valve respectively, and each of the corresponding ports of the data bus is connected to a respective one of data bus terminals of the main control module, the water feeding control module, the motor control module and the water discharge control module;

the power bus sequentially passes through the control panel, the water feeding valve, the load motor and the water discharge valve, the power bus is provided with corresponding ports at the control panel, the water feeding valve, the load motor and the water discharge valve respectively, and each of the corresponding ports of the power bus is connected to a respective one of power bus terminals of the main control module, the water feeding control module, the motor control module and the water discharge control module.

2. The modular computer board for a washing machine of claim 1, wherein at least two of the function control modules are arranged independently from the control circuit board, respectively.

3. The modular computer board for a washing machine of claim 1, wherein each of the function control modules arranged independently is disposed at any position between a cylinder and a housing of the washing machine.

4. The modular computer board for a washing machine of claim 1, wherein each of the function control modules arranged independently are mounted on or close to the corresponding loads.

5. The modular computer board for a washing machine of claim 1, wherein the function control modules arranged independently and the main control module are connected in series via the data bus, and the function control modules arranged independently and the main control module are connected in series via the power bus.

6. The modular computer board for a washing machine of claim 1, wherein the control circuit board having the main control module provided therein is mounted at the control panel, the main control module is connected to the control panel and is connected to each of the function control modules in series, so as to process and analyze a human-machine communication information reflected by the control panel and feedback information from each of the function control modules and send command signals to each of the function control modules.

7. The modular computer board for a washing machine of claim 1, wherein the load motor is a series-excited motor, a variable-frequency motor or a DD motor; and the motor control module is disposed in an independent circuit board which is mounted on or close to the load motor, the water feeding valve is configured for controlling the opening or closing of a water feeding tube of the washing machine, the water feeding control module is disposed in the independent circuit board which is mounted close to the water feeding valve, and the water discharge valve is configured for controlling on and off of the water discharge tube, the water discharge control module is disposed in an independent circuit board which is mounted close to the water discharge assembly.

8. The modular computer board for a washing machine of claim 1, wherein the function control modules further include one or two of a door lock control module, a drying control module, an automatic delivery control module and a heating control module.

9. The modular computer board for a washing machine of claim 8, wherein at least one of the door lock control module, the drying control module, the automatic delivery control module and the heating control module is disposed independently from the control circuit board.

10. The modular computer board for a washing machine of claim 8, wherein a load of the door lock control module is a door lock for locking a door body of the washing machine, a load of the drying control module is various drying assemblies constituting of a clothes drying system of the washing machine, a load of the automatic delivery control module is an automatic delivery module for controlling the delivery of a detergent from a detergent cartridge, and a load of the heating control module is a heating assembly in a heating system.

11. The modular computer board for a washing machine of claim 1, wherein each of the function control modules is provided with a data bus terminal which is connected to the data bus and a power bus terminal which is connected to the power bus.

12. The modular computer board for a washing machine of claim 2, wherein all of the function control modules are arranged independently from the control circuit board, respectively.

13. The modular computer board for a washing machine of claim 9, wherein the door lock control module, the drying control module, the automatic delivery control module and the heating control module are independently disposed from the control circuit board, respectively.

14. The modular computer board for a washing machine of claim 8, wherein the door lock control module is a control computer board that is mounted in a door lock of the washing machine for controlling the opening and close state of the door lock of the washing machine, the drying control module is a control computer board that is mounted close to a drying assembly of the washing machine for controlling operation states of the drying assembly of the washing machine, the automatic delivery control module is a control computer board that is mounted close to the automatic delivery module for controlling a mount of delivery of liquid detergents and/or detergent powders and/or softener, and the heating control module is an intelligent control computer board that is mounted close to a heating assembly of the washing machine for controlling the heating state of the heating assembly of the washing machine.

* * * * *